US010767345B2

(12) United States Patent
Hata

(10) Patent No.: US 10,767,345 B2
(45) Date of Patent: Sep. 8, 2020

(54) DEVICE AND METHOD FOR CONTROLLING WORK MACHINE

(71) Applicant: Caterpillar SARL, Geneva (CH)

(72) Inventor: Yoshihiko Hata, Tokyo (JP)

(73) Assignee: Caterpillar SARL, Geneva (CH)

( * ) Notice: Subject to any disclaimer, the term of this patent is extended or adjusted under 35 U.S.C. 154(b) by 314 days.

(21) Appl. No.: 15/572,733

(22) PCT Filed: May 3, 2016

(86) PCT No.: PCT/EP2016/059939
§ 371 (c)(1),
(2) Date: Nov. 8, 2017

(87) PCT Pub. No.: WO2016/180689
PCT Pub. Date: Nov. 17, 2016

(65) Prior Publication Data

US 2018/0135278 A1 May 17, 2018

(30) Foreign Application Priority Data

May 8, 2015 (JP) ..... 2015-095797

(51) Int. Cl.

| | |
|---|---|
| ***E02F 9/22*** | (2006.01) |
| ***F15B 21/08*** | (2006.01) |
| ***E02F 3/32*** | (2006.01) |
| ***F15B 11/16*** | (2006.01) |

(52) U.S. Cl.
CPC ..... *E02F 9/2203* (2013.01); *E02F 9/2246* (2013.01); *E02F 9/2292* (2013.01); *F15B 21/087* (2013.01); *E02F 3/32* (2013.01); *F15B 11/161* (2013.01)

(58) Field of Classification Search
CPC ..... E02F 9/2203; E02F 9/2246; E02F 9/2292; E02F 3/32; F15B 21/087; F15B 11/161; F15B 2211/275; F15B 13/02
See application file for complete search history.

(56) References Cited

FOREIGN PATENT DOCUMENTS

| | | | |
|---|---|---|---|
| CN | 1168942 | | 12/1997 |
| EP | 0795651 | A1 | 9/1997 |
| EP | 1020569 | A2 | 7/2000 |
| JP | 05280067 | | 10/1993 |
| JP | 07121374 | | 5/1995 |
| JP | 10018355 | | 1/1998 |
| JP | H10-266273 | A | 10/1998 |
| JP | 2001140806 | | 5/2001 |
| JP | 2012-017677 | A | 1/2012 |
| WO | 2004072858 | | 8/2004 |

*Primary Examiner* — Tuan C To
*Assistant Examiner* — Kelly D Williams

(57) ABSTRACT

The amount of work of a work machine (11) is estimated using fuzzy logic based on the amount of operation of control units (L1) to (L4) which operate a hydraulic swing motor (16*m*) and cylinders (21*c*) to (23*c*). A setting signal, which sets the rotational speed of an engine (19) based on the estimated amount of work, is set using the fuzzy logic. The rotational speed of the engine (19) can be optimized according to the operator's operation intention with the control units (L1) to (L4), and energy loss of a hydraulic system can be suppressed.

2 Claims, 7 Drawing Sheets

CT CONTROL DEVICE
L1～L4 OPERATION MEANS
P1,P2 PUMP
11 WORK MACHINE
16m FLUID PRESSURE ACTUATOR
19 ENGINE
21c,22c,23c FLUID PRESSURE ACTUATOR
33 WEIGHTING MEANS
34 ESTIMATION MEANS
36 SETTING MEANS

CT CONTROL DEVICE
L1～L4 OPERATION MEANS
P1,P2 PUMP
11 WORK MACHINE
16m FLUID PRESSURE ACTUATOR
19 ENGINE
21c,22c,23c FLUID PRESSURE ACTUATOR
33 WEIGHTING MEANS
34 ESTIMATION MEANS
36 SETTING MEANS

DEVICE AND METHOD FOR CONTROLLING WORK MACHINE

CROSS-REFERENCE TO RELATED APPLICATIONS

This application is a national phase application of International Patent Application No. PCT/EP2016/059939 filed May 3, 2016, which claims priority to Japanese Patent Application No. 2015-095797 filed May 8, 2015, both of which are incorporated by reference herein in their entireties for all purposes.

TECHNICAL FIELD

The present invention relates to a device and a method for controlling a work machine that has a fluid pressure system including a fluid pressure actuator for operating the work machine and a pump for discharging a working fluid for operating the fluid pressure actuator, and an engine for driving the pump.

BACKGROUND ART

A conventional work machine such as a hydraulic shovel executes various tasks using a work device and also turns the upper revolving body with respect to the lower traveling body by operating hydraulic actuators such as a hydraulic cylinder and a hydraulic motor with hydraulic oil that is discharged from a hydraulic pump driven by the engine.

In some cases the operator of such work machine does not need to perform leveling (smoothing of the ground) or crane operations using the maximum power of the hydraulic system or at the maximum speed thereof. In such a case, while the power required in the hydraulic system is low because the amount of lever operation by the operator is small and the speeds of the hydraulic actuators are low, the energy loss of the hydraulic system is high because the amount of hydraulic oil to be bled off to a tank through, for example, a control valve is high or the energy loss is high in the pump due to the lowered efficiency. Therefore, the hydraulic system is required to be used at its efficient point in accordance with the work amounts of the hydraulic actuators associated with the operation of the lever by the operator.

For example, a configuration has been known in which each task is identified using fuzzy inference based on the amount of lever operation by the operator [(see, for example, PTL 1 to PTL 5)]. However, the known configurations aim to identify the type of task and improve the operability merely by controlling pump flow rates or changing the state of an engine auto deceleration control, so the use of the hydraulic system at its efficient point is not taken into consideration.

SUMMARY OF THE INVENTION

However, the configurations described in PTL 1 to PTL 5 aim to identify the type of the task and improve the operability, and merely control the pump flow rates or change the validity/invalidity of so-called engine auto deceleration control, and the use of the hydraulic system at its efficient point is not taken into consideration.

The present invention has been contrived in view of these circumstances, and an object thereof is to provide a device and a method for controlling a work machine that are designed to curb energy loss of a fluid pressure system.

The present disclosure describes a control device and method for controlling a work machine having a fluid pressure system that includes a fluid pressure actuator for operating the work machine and a pump for discharging a working fluid for operating the fluid pressure actuator, and an engine for driving the pump, the control device having: estimation means for estimating a work amount of the work machine by using fuzzy inference based on an operation amount the fluid pressure actuator is operated by operation means; and setting means for setting a setting signal by using fuzzy inference, the setting signal being used for setting the engine speed in accordance with the work amount estimated by the estimation means.

BRIEF DESCRIPTION OF DRAWINGS

FIG. 8 is a graph showing a temporal change in centroid value obtained based on FIGS. 8(*c*) to 8(*e*).

DESCRIPTION OF EMBODIMENTS

The present invention is described hereinafter in detail based on an embodiment shown in FIGS. 1 to 8.

Figure 7:
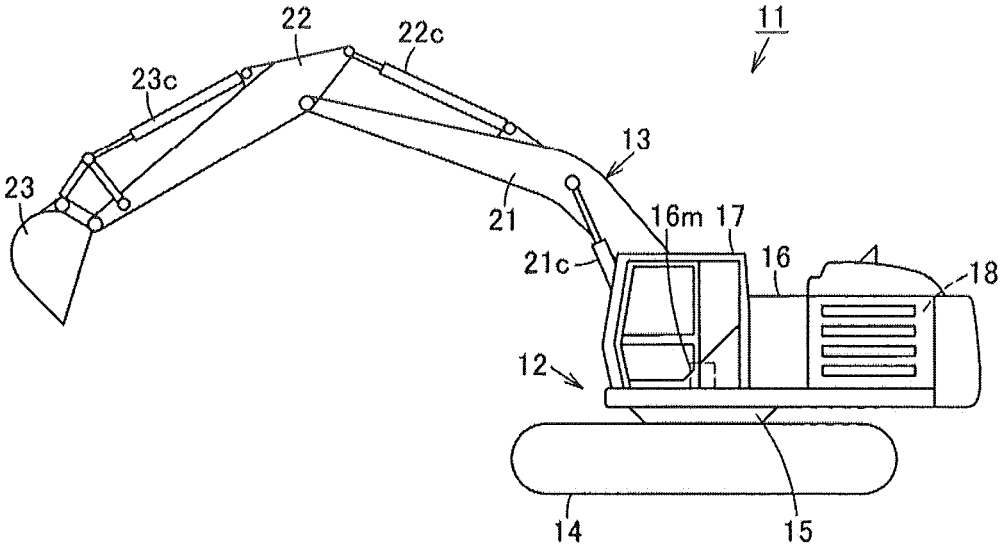
FIG. 7 is a side view of the work machine having the control device.

FIG. 7 shows a work machine 11 as a hydraulic shovel. This work machine 11 has a hydraulically-operated (fluid pressure-driven) chassis 12 and a hydraulically-operated (fluid pressure-driven) work device 13 mounted to the chassis 12. In the chassis 12, an upper revolving body 16 is provided on a lower traveling body 14 with a revolving bearing 15 therebetween, in such a manner as to be revolved by a revolving hydraulic motor 16*m*. A cab 17 configuring an operator's station and a machine room 18 are mounted in the upper revolving body 16, wherein an engine 19 shown in FIG. 1 and (first and second) pumps P1, P2 driven by this engine 19 are mounted in the machine room 18.

The work device 13 has a boom 21 that is axially supported by the upper revolving body 16 and rotated by a boom cylinder 21*c*, a stick 22 that is axially coupled to a tip of the boom 21 and rotated by a stick cylinder 22*c*, and a bucket 23 that is attached to a member axially coupled to a tip of the stick 22 and rotated by a bucket cylinder 23*c*.

The pumps P1, P2 are of variable swash plate type or variable capacity pumpshaving capacity controllers $\phi$1, $\phi$2 such as swash plate regulators. These pumps P1, P2 are connected to an output shaft 19*a* of the engine 19 and driven by the engine 19. Output channels 27, 28 of these pumps P1, P2 are connected to a control valve CV. Through this control valve CV, hydraulic oil as a working fluid is supplied to the revolving hydraulic motor 16*m* functioning as a revolving motor, which is a fluid pressure actuator, the boom cylinder 21*c* functioning as a hydraulic cylinder, which is a fluid pressure actuator, the stick cylinder 22*c* functioning as a hydraulic cylinder, which is a fluid pressure actuator, and the bucket cylinder 23*c* functioning as a hydraulic cylinder, which is a fluid pressure actuator. In the present embodiment, the pump P1, for example, supplies the hydraulic oil to the boom cylinder 21*c* and the bucket cylinder 23*c*, and the pump P2 supplies the hydraulic oil to the revolving hydraulic motor 16*m* and the stick cylinder 22*c*.

Displacement of the control valve CV is controlled in accordance with the operation amounts of operation means (operation levers) L1 to L4 such as hydraulic or electric levers provided in the operator's station (i.e., the inclination angles or the levels of displacement of the respective operation means (operation levers) with respect to a neutral position). One of the control valve CV consists of a spool or the like provided slidably in, for example, a single block, controls the direction and flow rate of the hydraulic oil supplied by each of the pumps P1, P2, and then supplies the resultant hydraulic oil to the revolving hydraulic motor 16*m*, the stick cylinder 22*c*, the boom cylinder 21*c*, and the bucket cylinder 23*c*. In the control valve CV, connection from the pump P1, P2 to a tank T is established through center bypass lines, not shown, that are formed in each of the spool. Negative flow control pressure (NFC pressure) obtained from the center bypass lines are fed back from, for example, a control device CT to the capacity controllers ϕ1, ϕ2 of the pumps P1, P2. The NFC pressure is configured to control the discharge flow rates of the pumps P1, P2 in such a manner that the NFC pressure is maximum when the spool of the control valve CV is at the neutral position, that the greater the level of displacement of the spool, the lower the NFC pressure becomes, that the higher the NFC pressure, the lower the pump flow rates are made by the capacity controllers ϕ1, ϕ2 of the pumps P1, P2, and that the lower the NFC pressure, the higher the pump flow rates are (NFC system). The inside of the block is also provided with spools and the like for controlling the direction and flow rate of hydraulic oil to be supplied to left and right traveling hydraulic motors (not shown) functioning as fluid pressure actuators, which are provided in, for example, the lower traveling body 14 of the chassis 12, and the operation means are provided in the operator's station so as to correspond to these spools. However, FIG. 1 only shows the circuits and operation means L1 to L4 corresponding to the revolving hydraulic motor 16*m* and the cylinders 21*c* to 23*c*, and omits the illustration of the other circuits and operation means. Although the present embodiment describes the control valve CV corresponding to the NFC system, the present embodiment is not limited to the NFC system and therefore can be applied to other control valves CV.

The control device CT has a rotational frequency control function for controlling the engine speed 19, and a discharge amount control function for controlling the amounts of hydraulic oil discharged from the pumps P1, P2 by controlling the capacities of the pumps P1, P2. Specifically, the control device CT generates a setting signal 30 based on the rated rotational frequency and the differential rotational frequency set beforehand while detecting the engine speed 19 by using a rotational frequency sensor, not shown. The setting signal 30 is an electrical signal (such as a current) for controlling the fuel injection timing and injection amount of a fuel injector installed in the engine 19. The control device CT also controls the discharge flow rates of the pumps P1, P2 by outputting, to the capacity controllers ϕ1, ϕ2 of the pumps P1, P2, an electrical signal (such as a current) corresponding to the NFC pressure detected by a pressure sensor, not shown. The control device CT also generates an electrical signal (such as a current) such as the foregoing control signals in accordance with the operation amounts of the operation means L1 to L4, i.e., the operation amount of at least any of the spools of the control valve CV or, in the present embodiment, the operation amount of each of the spools.

Figure 1:
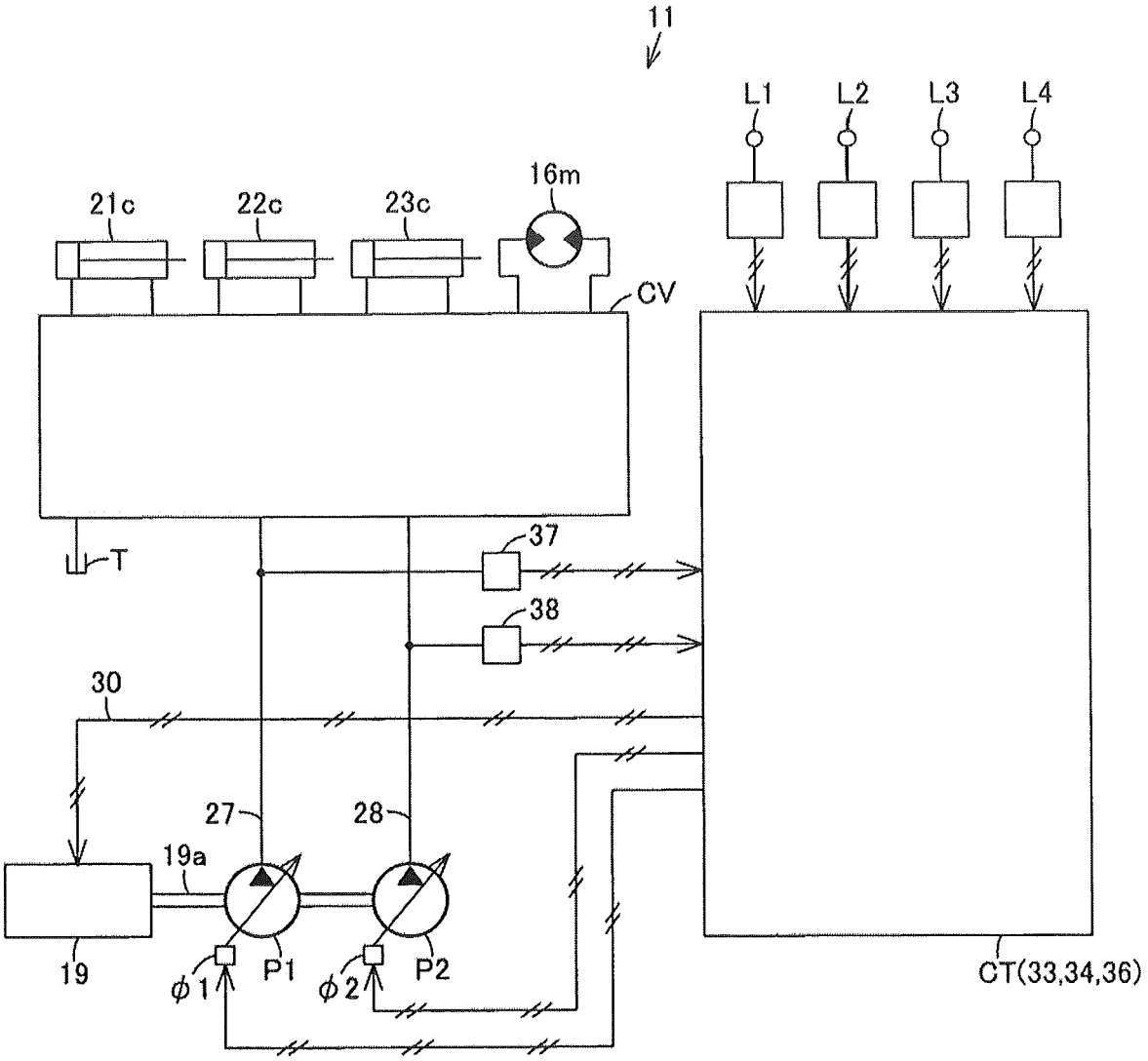
FIG. 1 is a circuit diagram showing an embodiment of a control device for controlling a work machine according to the present invention.
Figure 2:
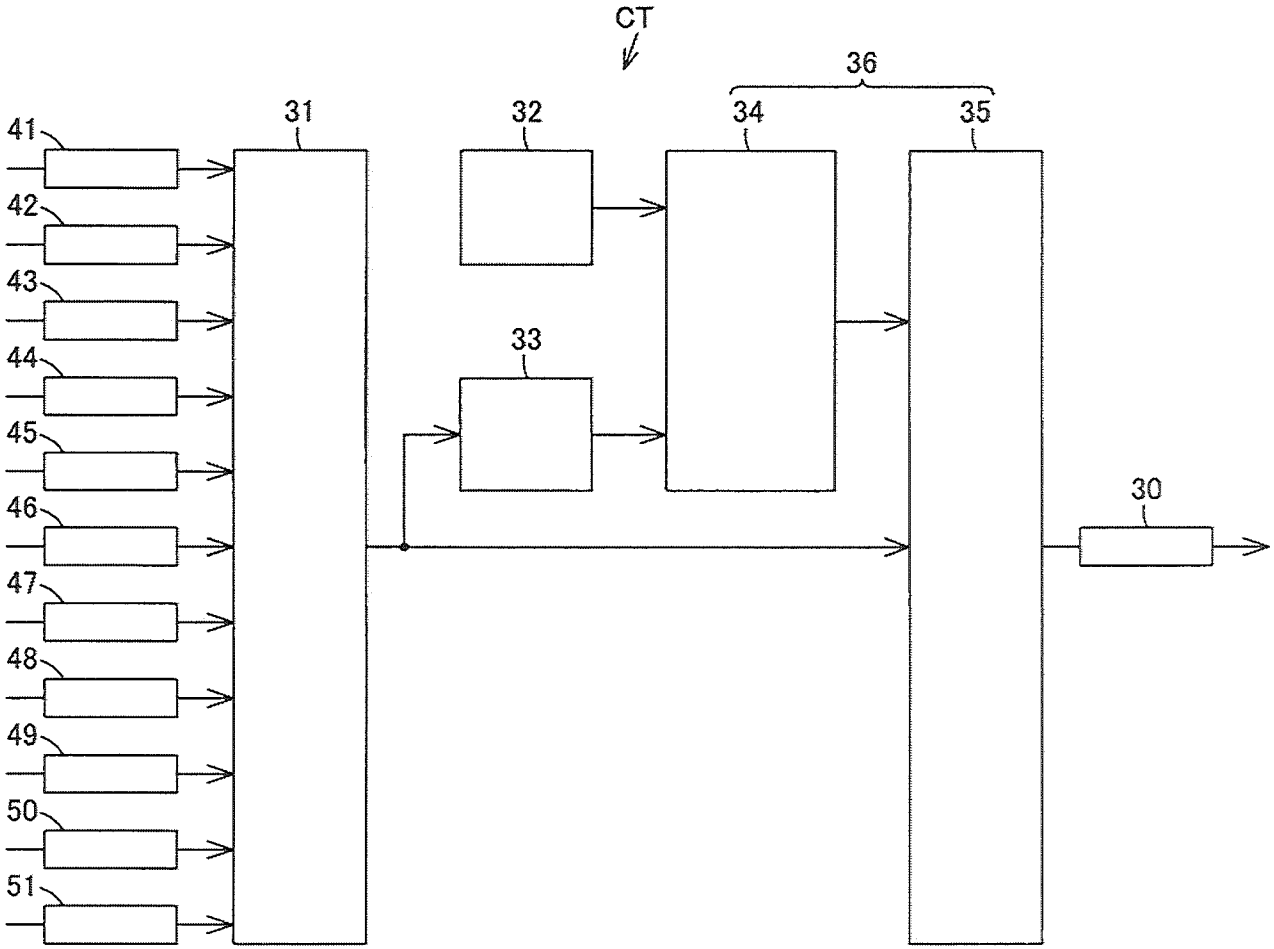
FIG. 2 is a block diagram showing an internal structure of a part of the control device.

How the rotational frequency control function of the control device CT sets the engine speed 19 is now described specifically. As shown in FIG. 2, the control device CT has an input unit 31, an environment setting unit 32, a weighting unit 33 functioning as the weighting means, an estimation unit 34 functioning as the estimation means, an output unit 35 and the like. The estimation unit 34 and the output unit 35 configure a setting unit 36 that functions as the setting means for setting the setting signal 30 by using fuzzy inference, the setting signal 30 being used for setting the engine speed of engine 19 in accordance with the work amount estimated by the estimation unit 34. The control device CT estimates the work amount of the work machine 11, i.e. the work amounts of the revolving hydraulic motor 16*m* and the cylinders 21*c* to 23*c*, by using fuzzy inference and in accordance with the operation amount of each of the operation means L1 to L4, and sets the engine speed 19 in accordance with the estimated work amount.

The input unit 31 receives input of discharge pressures 41, 42 of the pumps P1, P2 that are detected by pressure sensors 37, 38 provided in the output channels 27, 28, a left revolution operation amount 43 and a right revolution operation amount 44 of the revolving hydraulic motor 16*m*, such as pilot pressures or electrical signals, which are set in accordance with the operation amount of the operation means L1 that is obtained when revolving the upper revolving body 16 to the left with respect to the lower traveling body 14, a boom lifting operation amount 45 and a boom lowering operation amount 46 of the boom cylinder 21*c*, such as pilot pressures or electrical signals, which are set in accordance with the boom lifting and lowering operation amounts obtained through the operation means L2, a stick-in operation amount 47 and a stick-out operation amount 48 of the stick cylinder 22*c*, such as pilot pressures and electrical signals, which are set in accordance with the stick-in and stick-out operation amounts obtained through the operation means L3, a bucket-in operation amount 49 and a bucket-out operation amount 50 of the bucket cylinder 23*c*, such as pilot pressures or electrical signals, which are set in accordance with the bucket-in and bucket-out operation amounts obtained through the operation means L4, and a determination flag (status flag) 51 for determining whether the operation means L1 to L4 are operated or not. The values that are input to this input unit 31 are each A/D-converted and output to the weighting unit 33 and the output unit 35.

The environment setting unit 32 sets various numerical values to be used by the estimation unit 34. For instance, the environment setting unit 32 sets a predetermined time period (e.g., 15 seconds) TP during which the work amount of the work machine 11 based on the operation amounts of the operation means L1 to L4 is detected, sampling rates SR for sampling the operation amounts of the operation means L1 to L4, weighting factors Wl, Wm, Wh corresponding to the fuzzy rules of the consequent parts of the fuzzy inference, and the like. The numerical values set by the environment setting unit 32 are stored in storage means (memory) not shown, and can be rewritten.

Figure 3:
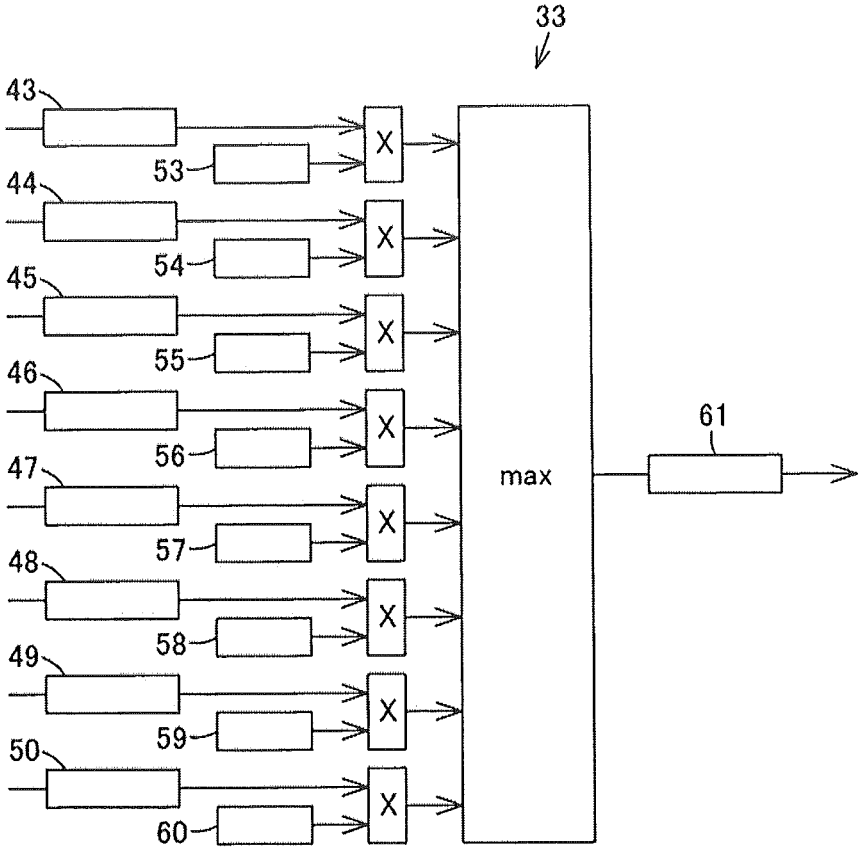
FIG. 3 is an explanation diagram showing weighting means of the control device.

The weighting unit 33 weights the operation amounts of the operation means L1 to L4. As shown in FIG. 3, the weighting unit 33 outputs, to the estimation unit 34, the maximum element out of the values obtained by multiplying operation amounts 43 to 50, which are set in accordance with the operation amounts of the operation means L1 to L4, by weighting coefficients (gains) 53 to 60 respectively. In other words, the weighting unit 33 outputs the maximum operation amount 61 to the estimation unit 34. These weighting coefficients 53 to 60 are set according to the operations of the revolving hydraulic motor 16*m* and the cylinders 21*c* to 23*c* that are operated by the operation means L1 to L4. In the present embodiment, the weighting coefficients 53 to 55, 57, and 59 corresponding to the operation amounts 43 to 45, 47, and 49 are set at 1, the weighting coefficient 56 corresponding to the boom lowering operation amount 46 at 0, and the weighting coefficients corresponding to the stick-out operation amount 48 and the bucket-out operation amount 50 at a predetermined value less than 1.

Figure 4:
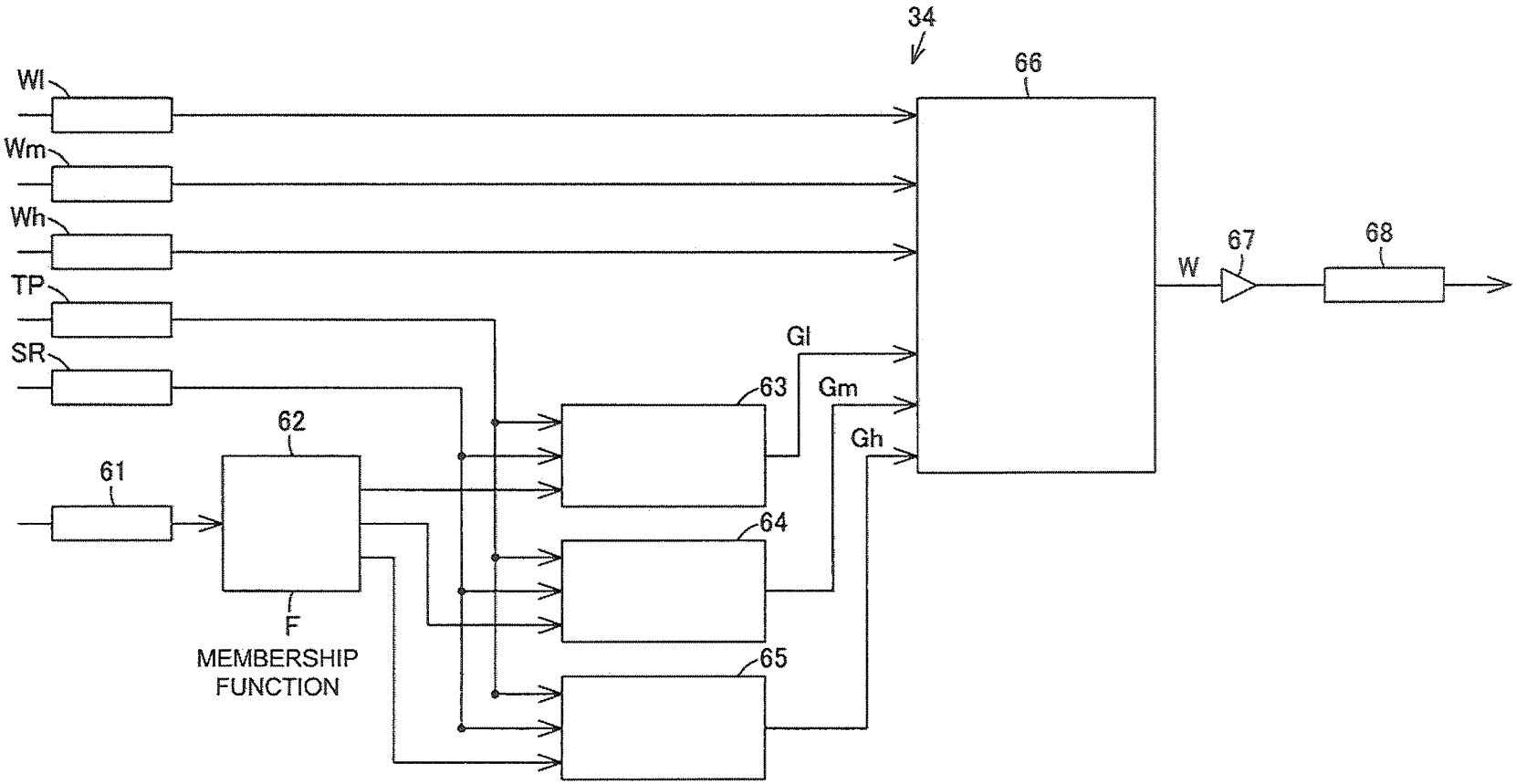
FIG. 4 is an explanation diagram showing estimation means of the control device.
Figure 5:
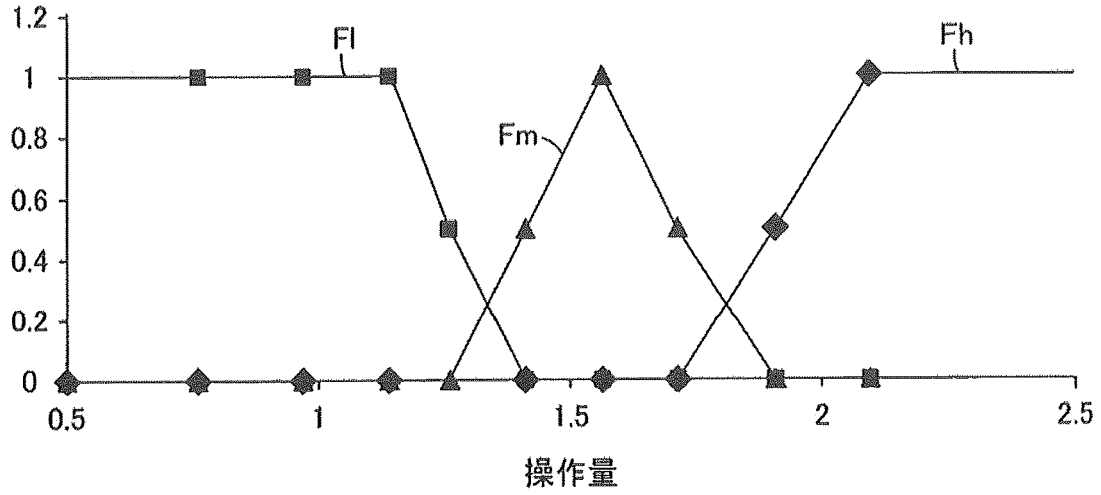
FIG. 5 is a graph showing an example of a membership function used in the control device.

The estimation unit 34 is a fuzzy inference computation unit that estimates and computes the work amount of the work machine 11 by using fuzzy inference, based on the operation amounts of the operation means L1 to L4 operating the revolving hydraulic motor 16*m* and the cylinders 21*c* to 23*c*. Specifically, as shown in FIG. 4, the estimation unit 34 has a membership function introduction unit 62 that introduces a membership function F to the maximum operation amount 61 input from the weighting unit 33, adaptation level calculation units 63 to 65 that calculate the adaptation levels (average value) to the antecedent parts of the fuzzy rules in the predetermined time period TP by using the numerical values input from the environment setting unit 32 and the membership function F introduced by the membership function introduction unit 62, a centroid value calculation unit 66 that performs defuzzification by calculating the centroid values of the consequent parts of the fuzzy rules using the adaptation levels calculated by the adaptation level calculation units 63 to 65 and the numerical values input by the environment setting unit 32, and an amplifier 67 for amplifying the centroid value calculated by the centroid value calculation unit 66. In the estimation unit 34, therefore, the membership function introduction unit 62 functions as an antecedent part computation unit for computing the antecedent parts of the fuzzy inference of the control device CT, and the adaptation level calculation units 63 to 65 and the centroid value calculation unit 66 function as consequent part computation units for computing the consequent parts of the fuzzy inference of the control device CT.

The membership function F used by the membership function introduction unit 62 quantitatively indicates the levels of requirement for the speeds of the revolving hydraulic motor 16*m* and cylinders 21*c* to 23*c*. In the present embodiment, as illustrated by the example in FIG. 5, for instance, the membership function is constituted of a function F1 representing the adaptation level when the levels of requirement for the speeds are low (referred to as "low level," hereinafter), a function Fm representing the adaptation level when the levels of requirement for the speeds are moderate (referred to as "medium level," hereinafter), and a function Fh representing the adaptation level when the levels of requirement for the speeds are high (referred to as "high level," hereinafter).

The adaptation level calculation units 63 to 65 each detect the low level, medium level, and high level of the membership function F introduced by the membership function introduction unit 62 for each sampling rate within the predetermined time period TP input from the environment setting unit 32, and obtains the adaptation levels (average value for each predetermined time period TP) Gl, Gm, Gh by dividing each of the detected levels by the predetermined time period TP.

The centroid value calculation unit 66 uses, for example, the adaptation levels Gl, Gm, Gh obtained by the adaptation level calculation units 63 to 65, to calculate a centroid value W based on, for example, W=(Wh*Gh+Wm*Gm+Wl*Gl)/(Gh+Gm+Gl). In the present embodiment, three fuzzy rules are set: (1) the engine speed 19 is kept as is in case of the high level, (2) the engine speed 19 is lowered in case of the medium level, and (3) the engine speed 19 is lowered significantly in case of the low level. In the present embodiment, therefore, the estimation unit 34 uses the fuzzy inference to calculate the amount of reduction in the engine speed 19, i.e., the differential rotational frequency. The weighting factors Wh, Wm, Wl are set in accordance with the consequent parts of these three fuzzy rules. In the present embodiment, these weighting factors are equal to or less than 0 and set such as Wh>Wm>Wl.

The amplifier 67 outputs a differential rotational frequency 68, which is an output value obtained by amplifying the centroid value W by a predetermined amplification degree (e.g., 1), to the output unit 35 shown in FIG. 2.

Then, only when the determination flag 51 determines that the operation means L1 to L4 are operated, the output unit 35 outputs the setting signal 30, an electrical signal obtained by processing the differential rotational frequency 68. The fuel injection timing and injection amount of the fuel injector installed in the engine 19 are controlled based on the setting signal 30 output from the output unit 35 and a predetermined rated rotational frequency that is set beforehand by setting means such as an acceleration dial, not shown, thereby controlling the engine speed 19 to a target rotational frequency ((rated rotational frequency+(differential rotational frequency)).

Figure 6:
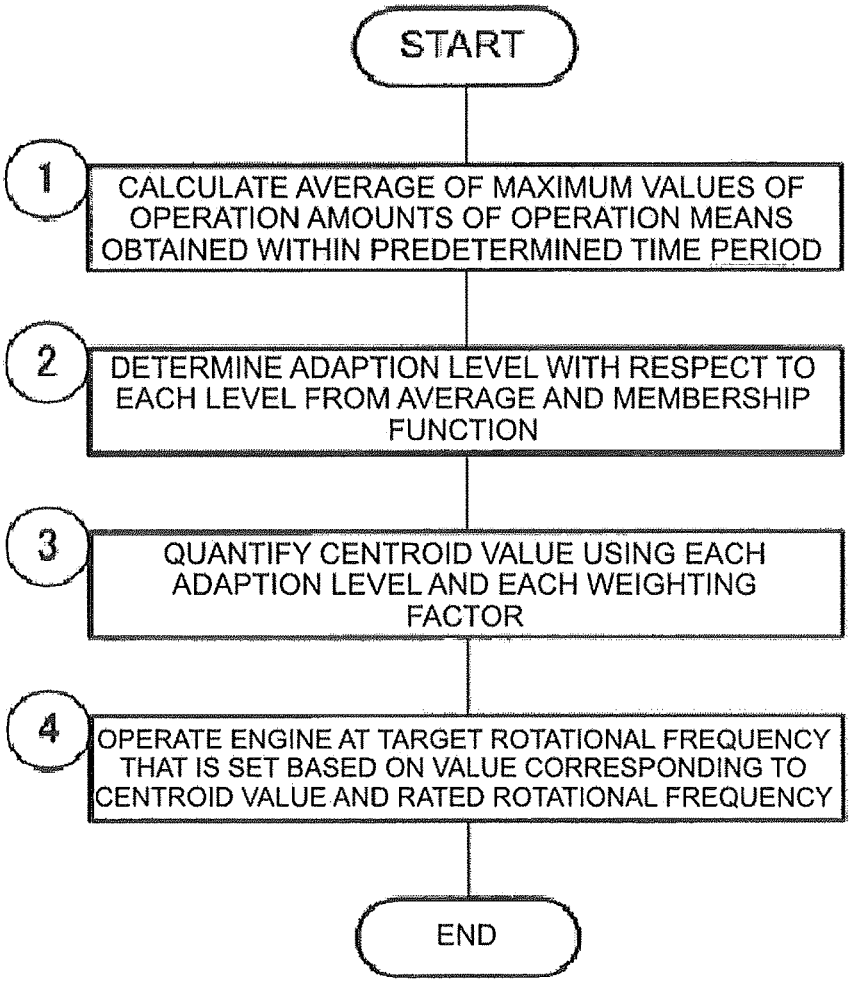
FIG. 6 is a flowchart of a control method used by the control device.

Next, the control method according to the present embodiment is described with reference to the flowchart shown in FIG. 6. The numbers in the circles shown in FIG. 6 represent the step numbers.

Step 1

First, the control device CT calculates the average value of the maximum values of the operation amounts of the operation means L1 to L4 within the predetermined time period TP. In so doing, the estimation unit 34 causes the adaptation level calculation units 63 to 65 to calculate the average value within the predetermined time period TP with respect to the maximum operation amount 61 corresponding to the maximum values of the operation amounts of the operation means L1 to L4 that are weighted by the weighting unit 33.

Step 2

Next, using the membership function F introduced by the membership function introduction unit 62, the control device CT causes the adaptation level calculation unit 63 to 65 of the estimation unit 34 to determine the adaptation levels Gl, Gm, Gh with respect to each level of the average value of the operation amounts of the operation means L1 to L4 that are obtained in step 1 (fuzzification). Note that, using the membership function F introduced by the membership function introduction unit 62, the control device CT may calculate the adaptation levels corresponding to the levels of the operation amounts of the operation means L1 to L4 and then calculate the average value of these adaptation levels within the predetermined time period TP.

Step 3

The control device CT also causes the centroid value calculation unit 66 of the setting unit 36 (the estimation unit 34) to quantify the centroid value W by using the adaptation levels Gl, Gm, Gh obtained in step 2 and the weighting factors Wl, Wm, Wh set by the environment setting unit 32 (defuzzification).

Step 4

The control device CT causes the output unit 35 to convert the value corresponding to (proportional to) the centroid value W quantified in step 3, into the setting signal 30, and then operates the engine 19 at the target rotational frequency that is set based on this setting signal 30 and the signal into which the value corresponding to the rated rotational frequency is converted.

Figure 8:
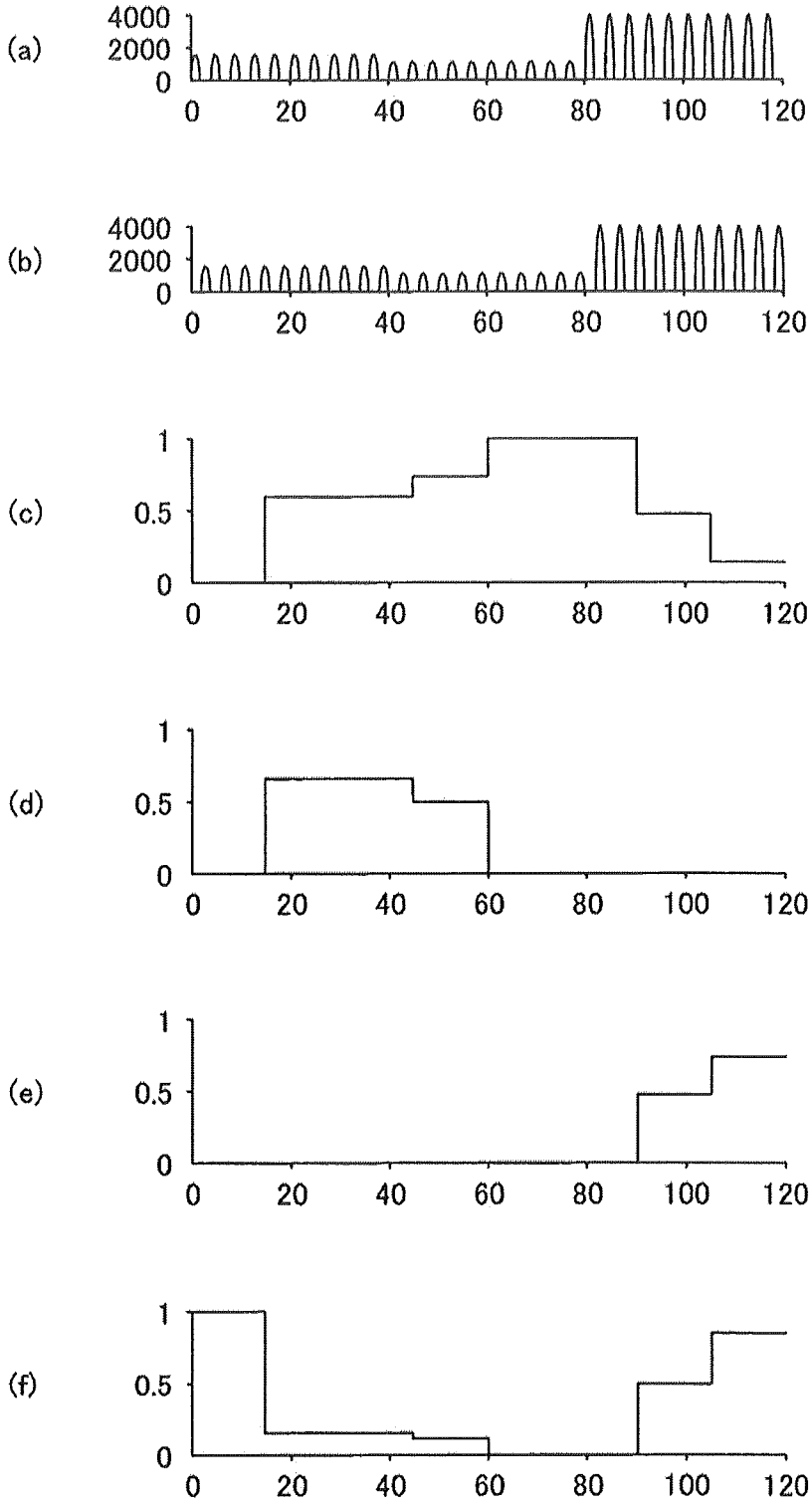
FIG. 8(*a*) is a graph showing the amount of a stick-in operation as an example of the control device, FIG. 8(*b*) is a graph showing the amount of a stick-out operation, FIG. 8(*c*) is a graph showing a temporal change in adaptation level with respect to the low level, FIG. 8(*d*) is a graph showing a temporal change in adaptation level with respect to the medium level, FIG. 8(*e*) is a graph showing a temporal change in adaptation level with respect to the high level.

Specifically, a case is considered in which when leveling (smoothing of the ground) is performed, the stick-in operation amount 47 and the stick-out operation amount 48 of the stick cylinder 22*c* fluctuate as shown in FIG. 8(*a*) and FIG. 8(*b*). As shown by the pilot pressures in FIG. 8(*a*) and FIG. 8(*b*), when these operation amounts fluctuate between −1.5 MPa to 1.5 MPa from 0 to 40 seconds, between −1.0 MPa to 1.0 MPa from 40 to 80 seconds, and between −4.0 MPa to 4.0 MPa from 80 to 120 seconds, the adaptation levels Gl, Gm, Gh corresponding to the average value of the operation amounts within the predetermined time period TP (15 seconds) are obtained with respect to the low level, medium level, and high level as shown in FIGS. 8(*c*) to 8(*e*). In the present embodiment, the centroid value W for each time is obtained as shown in FIG. 8(*f*) by establishing, for example, Wh=0, Wm=−100, and Wl=−200 with respect to these adaptation levels Gl, Gm, Gh. Then, the engine speed of the engine 19 is controlled to the target rotational frequency obtained by adding the rotational frequency corresponding to (proportional to) this centroid value W to the rated rotational frequency.

As described above, according to the foregoing embodiment, the work amount of the work machine 11 is estimated by the estimation unit 34 using fuzzy inference based on the operation amounts of the operation means L1 to L4 operating the revolving hydraulic motor 16*m* and the cylinders 21*c* to 23*c*, and then the setting signal for setting the engine speed of the engine 19 is set by the setting unit 36 using fuzzy inference in accordance with the estimated work amount. Therefore, the engine speed can be optimized in accordance with the intention of the operator in operating the operation means L1 to L4. In other words, the efficient parts of the engine 19 and the pumps P1, P2 can be used.

Specifically, in a case where the operation amounts of the operation means L1 to L4 are low, the operating speeds of the revolving hydraulic motor 16*m* and cylinders 21*c* to 23*c* are almost the same, although the engine speed varies depending on the operation such as the stick-out operation. For this reason, when the amounts the operation means L1 to L4 are operated by the operator are low, the levels of requirement for the speeds the revolving hydraulic motor 16*m* and cylinders 21*c* to 23*c* are basically low as well, and the required power of the hydraulic system does not need to be high. However, reducing the flow rates of the pumps P1, P2 with the intention of reducing the energy loss caused by bleeding the hydraulic oil off to the tank T leads to a decrease in efficiency of the pumps P1, P2 themselves, resulting in not being able to reduce the energy loss. The present embodiment, on the other hand, employs the NFC system, to reduce the engine speed of the engine 19. Thus, the efficiency of the pumps P1, P2 is not lowered easily because the swash plates of the variable capacity-type pumps P1, P2 start to rise naturally even when the operation amounts of the operation means L1 to L4 are the same.

As a result, the energy loss of the hydraulic system including the pumps P1, P2, the revolving hydraulic motor 16*m*, and the cylinders 21*c* to 23*c* can be reduced.

Specifically, the accuracy of estimating the work amount of the work machine 11 can be further improved by causing the estimation unit 34 to estimate the work amount of the work machine 11 based on the average value of the maximum values of the operation amounts of the operation means L1 to L4 obtained within the predetermined time period TP and the membership function F representing the predetermined levels of requirement for the speeds of the revolving hydraulic motor 16*m* and cylinders 21*c* to 23*c*.

Particularly, the estimation accuracy can be further improved by using the weighted operation amounts of the operation means L1 to L4 to estimate the work amount of the work machine 11 using the estimation unit 34. As a result, the engine speed can be controlled to the rotational frequency that fits with the operations of the revolving hydraulic motor 16*m* and the cylinders 21*c* to 23*c* operated by the operation means L1 to L4. Consequently, not only it is possible to reduce the energy loss of the hydraulic system more reliably, but also the engine speed with respect to the operation means L1 to L4 is prevented from changing drastically.

Therefore, the engine speed can be controlled to the rotational frequency suitable for a task, improving fuel consumption.

According to the foregoing embodiment, the membership function F, the weighting factors Wl, Wm, Wh and the like can be set arbitrarily based on the set fuzzy rules.

The levels of requirement for the speeds of the revolving hydraulic motor 16*m* and the cylinders 21*c* to 23*c* do not have to be three (low level, medium level, high level), and two, four or more levels can be set.

The present invention is suitable for a hydraulic shovel-type work machine and can also be applied to a wheel-type work machine as long as it has a work device protruding from the chassis.

INDUSTRIAL APPLICABILITY

The present invention is industrially applicable to all businesses that are concerned in manufacturing and sales of work machines equipped with fluid pressure systems having fluid pressure actuators and pumps.

The invention claimed is:

1. A control device for controlling a work machine, the work machine having a fluid pressure system that includes a plurality of fluid pressure actuators for operating the work machine, a plurality of operation means for operating the plurality of fluid pressure actuators, and a pump for discharging a working fluid for operating the plurality of fluid pressure actuators; and an engine for driving the pump, the control device comprising:

estimation means for estimating a work amount of the work machine by using fuzzy inference based on operation amounts of the plurality of operation means to operate the plurality of fluid pressure actuators;

setting means for setting a setting signal by using fuzzy inference, the setting signal being used for setting an engine speed in accordance with the work amount estimated by the estimation means; and weighting means for weighting the operation amount of each operation means of the plurality of operation means, wherein the estimation means estimates the work amount of the work machine based on an average value of maximum values of the operation amounts of the plurality of operation means that are weighted by the weighting means, the maximum values being obtained within a predetermined time period, and a membership function representing predetermined levels of requirement for speeds of the plurality of fluid pressure actuators.

2. A control method for controlling a work machine, the work machine having a fluid pressure system that includes a plurality of fluid pressure actuators for operating the work machine, a plurality of operation means for operating the plurality of fluid pressure actuators, and a pump for discharging a working fluid for operating the plurality of fluid pressure actuators; and an engine for driving the pump, the control method comprising the steps of:

estimating a work amount of the work machine by using fuzzy inference based on an operation amount the plurality of fluid pressure actuators is operated by the plurality of operation means;

setting a setting signal by using fuzzy inference, the setting signal being used for setting the engine speed in accordance with the estimated work amount;

weighting the operation amount of each operation means of the plurality of operation means; and estimating the work amount of the work machine based on an average value of maximum values of the weighted operation amounts of the plurality of operation means obtained within a predetermined time period, and a membership function representing predetermined levels of requirement for speeds of the plurality of fluid pressure actuators.

* * * * *